US006004077A

United States Patent [19]

Saab

[11] Patent Number: 6,004,077

[45] Date of Patent: Dec. 21, 1999

[54] SYSTEM FOR SECUREMENT OF A MESH SCREENING MEANS AND METHOD OF INSTALLATION

[76] Inventor: Thomas L. Saab, 1390 Hazelton Blvd., Burlington, Canada, L7P 4V3

[21] Appl. No.: 09/030,010

[22] Filed: Feb. 25, 1998

[51] Int. Cl.[6] ..... E02D 3/02

[52] U.S. Cl. ..... 405/302.3; 405/288; 405/302.1

[58] Field of Search ..... 405/288, 302.1, 405/302.3

[56] References Cited

U.S. PATENT DOCUMENTS 4,740,111 4/1988 Gagnon ..... 405/288 X
5,207,535 5/1993 Saab ..... 405/302.3

*Primary Examiner*—David Bagnell
*Assistant Examiner*—Sunil Singh
*Attorney, Agent, or Firm*—Patrick J. Hofbauer

[57] ABSTRACT

A system for securement of a mesh screen on the protruding, threaded end of a rock bolt inserted into a rock face comprising a push-on gripper plate, having a generally planar base portion adapted to overlie the mesh screen, and an installation tool. The gripper plate has a magnetically grippable contact surface for operative engagement with the installation tool. The installation tool has a handle portion with a main body portion rigidly attached thereto. The main body portion has a magnet to magnetically engage the magnetically grippable contact surface of the gripper plate, and a cavity dimensioned and adapted to non-frictionally receive the protruding, threaded end of the rock bolt during installation of the gripper plate. A ram is rigidly attached to the opposite other end of the handle portion of the installation tool. A method of installing a gripper plate onto the protruding, threaded end of a rock bolt is also provided.

26 Claims, 5 Drawing Sheets

SYSTEM FOR SECUREMENT OF A MESH SCREENING MEANS AND METHOD OF INSTALLATION

FIELD OF THE INVENTION

The present invention relates to a system for securement of a mesh screening means onto the protruding, threaded end portion of a rock bolt inserted into a rock face, such as would be used in mine roof stabilization. More particularly, the system comprises a gripper plate and a magnetic installation tool to assist in installing the gripper plate on the end of the rock bolt.

BACKGROUND OF THE INVENTION

It is well known in the mining and shoring arts to utilize rock bolts to secure a wire mesh over the rock face of a mine roof or wall so as to stabilize the rock face and reduce the risk of injury to mine personnel by way of falling rock. Similar mesh screening means are sometimes used in excavation and shoring operations where rock or shale faces may be exposed. In both types of such operations, a suitably sized hole is drilled into the rock or shale material generally perpendicular to its face, and the rock bolt is inserted into the hole to a depth at which its threaded free end protrudes beyond the rock face by several inches. The rock bolts are retained in the drilled holes by any conventional means, and such retention means, together with the rock bolts themselves are well-known and are not part of the present invention.

After insertion of each rock bolt into a pre-drilled hole, a retention plate having a centrally positioned hole is typically placed over the protruding free end portion of the rock bolt and a conventional washer and nut are threaded onto this free end to hold fast the retention plate against the rock face and thereby stabilize the rock bolt within the rock material. Once the rock bolts are installed in this manner, a wire mesh can be applied over the rock face and held thereagainst typically by use of a gripper plate attached to each of the rock bolts.

Prior art gripper plates for this purpose are known, such as those disclosed in U.S. Pat. No. 5,207,535 (Saab) and U.S. Pat. No. 4,740,111 (Gagnon). During installation of prior art gripper plates, the gripper plate is pushed onto the rock bolt to secure the mesh screening, and is held in frictional engagement with the protruding end of the rock bolt by teeth, or other gripping means positioned on the body of the gripper plate. A socket wrench, or other device having a hollow cylindrical body portion is typically used as an installation tool to assist in driving home the gripper plate onto the protruding free end of the rock bolt in retaining engagement against the wire mesh. Frequently, the cylindrical installation tool is attached to a pneumatic drill, known as a "jackleg" to assist in such installation. Pneumatic drills are known to be quite heavy to lift, weighing perhaps seventy (70) pounds or more.

Mesh screening of the type under discussion is typically applied to support the ceilings and side wall faces of mine shafts, and the installer of the mesh has to work at levels at or above chest height, and frequently above his/her head. Thus, the installation of prior art gripper plates, necessitating, as it does, the use of a pneumatic drill, results in the installer having to lift the weight of the pneumatic drill, the installation tool, and a gripper plate attached to the installation tool, in order to install each gripper plate. The process is awkward, time consuming and requires significant strength and endurance on the part of the installer. Moreover, conventional gripper plates require aligned placement of the installation tool within a plurality of upstanding tabs or the like formed integrally with the lower surface of the gripper plate. The alignment is done manually by the installer. Thus, installing a gripper plate involves the steps of: retrieving a gripper plate by hand from a stored supply of gripper plates; manually fitting the gripper plate on the free end of the installation tool within the alignment tabs of the gripper plate; manoeuvring the installation tool, (and the attached pneumatic drill), with the gripper plate balanced thereon in said aligned configuration, into position adjacent to the already installed rock bolt; and installing the gripper plate over the wire mesh on the protruding end of the rock bolt by activation of the pneumatic drill.

Placement of the gripper plate in aligned relation on the free end of the of the installation tool requires several seconds for each gripper plate installed, and does not prevent the gripper plate from tilting or falling off of the installation tool while being lifted to the mine ceiling for engagement with the rock bolt. Moreover, such vertical tilting frequently results in the gripper plate contacting the threaded end of the rock bolt at an angle which causes deformation of the gripper plate teeth and inadequate and unpredictable frictional engagement by the gripper plate teeth with the threads of the rock bolt during the turning or pressing of the gripper plate into position on the protruding end of the rock bolt. When this occurs, the amount of weight which a mis-aligned gripper can support before disengagement from the rock bolt decreases, with a consequential decrease in the safety margin of the installation. In order to ensure uniform safety standards in a mining environment, such an improperly installed gripper plate would have to be removed and replaced.

Additionally, while manoeuvring the installation tool/gripper plate combination towards the protruding free end of the rock bolt, it is not uncommon for the gripper plate aligned and balanced on said free end of the installation tool to fall to the mine floor, posing a safety hazard to the installer or other workers in the area. Moreover, the retrieval of fallen gripper plates is a source of delay and frustration in the process of installing the mesh screening if they are retrieved, and an additional cost to the mine operation if they are not.

Accordingly, it is an object of the present invention to provide a system for securement of a mesh screening means on the protruding, threaded end portion of a rock bolt inserted into a rock face having a gripper plate and an installation tool which are easily and reliably engageable with one another.

It is a further object of the present invention to provide such a system in which no fine manual alignment of the installation tool with respect to a gripper plate is required prior to the engagement thereof.

It is a further object of the present invention to provide such a system in which a gripper plate and installation tool are self aligning and remain secured in engagement one with the other until the teeth of the gripper plate have fully engaged the threaded end of the rock bolt.

It is yet another object of the present invention to provide such a system which will completely install a gripper plate using the installation tool alone, and does not necessarily require the use of a pneumatic drill or other subsidiary means to assist in installing the gripper plate on the threaded end of the rock bolt in fully secured relation.

It is still a further object of the present invention to provide such a system in which the installation tool is of lighter weight than the conventional combination of an installation tool used in combination with a pneumatic drill to increase the dexterity and reduce the fatigue of an installer.

It is still a further object of the present invention to provide such a system in which both the gripper plate and the installation tool are simple, robust, and cost effective to manufacture.

It is yet a further object of the present invention to provide a method for installing a gripper plate on the protruding, threaded end of a rock bolt inserted into a rock face utilizing the system of the present invention.

SUMMARY OF THE INVENTION

In accordance with the present invention there is disclosed a system for securement of a mesh screening means onto the protruding, threaded, end portion of a rock bolt inserted into a rock face, comprising, in combination, a push-on gripper plate having a generally planar base portion adapted to overlie the mesh screening means. The planar base portion has, on a first side thereof, a plurality of teeth adapted to frictionally engaged the protruding, threaded end portion of the rock bolt, and a magnetically grippable contact surface for operative engagement with an installation tool. An installation tool is provided having an elongated handle portion defining a longitudinal axis, and a main body portion. The main body portion has a proximal end wall oriented substantially transversely to the longitudinal axis, and an inner sidewall of substantially closed polygonal cross-section extending longitudinally from the proximal end wall to terminate in a distal end wall spaced from the proximal end wall. The distal end wall is oriented in substantially parallel orientation to the proximal end wall and defines a central portal through which the longitudinal axis passes. The inner sidewall and the distal end wall together define, within the main body portion, a first longitudinally oriented cavity positioned and otherwise adapted, in use, to non-frictionally receive the protruding, threaded end portion of the rock bolt through the central portal during the installation of the gripper plate. The main body portion also has a means for exerting an attractive magnetic force in a direction substantially parallel to the longitudinal axis. The means is positioned on the distal end wall of the main body portion so as to magnetically attract the magnetically grippable contact surface of the gripper plate into magnetically retained contacting engagement with the distal end wall of the installation tool. The elongated handle portion is rigidly attached to the main body portion adjacent the proximal end wall thereof, thereby to effect the substantially transverse orientation of the proximal end wall to the longitudinal axis. A ramming means is preferably rigidly affixed to the opposite other end of the elongated handle portion of the installation tool.

A method is also provided for installing a gripper plate on the protruding, threaded end of a rock bolt inserted into a rock face, in overlying retaining contact with a mesh screening means. The gripper plate has a plurality of teeth positioned on the perimeter of a central opening in the gripper plate. The method preferably comprises the following steps. The first step is orienting the gripper plate, selected from a stockpile of similar gripper plates, on a planar magnetic engagement surface of an installation tool with a magnetically grippable contact surface of said gripper plate engaged by a planar magnetic engagement surface of the installation tool and the teeth operatively oriented within a first longitudinally oriented cavity of the installation tool, thereby to operatively, magnetically engage the gripper plate to the main body portion of the installation tool. The second step is positioning the oriented gripper plate, adjacent the protruding, threaded end of the rock bolt, with the central opening of the gripper plate axially aligned with the protruding, threaded end of the rock bolt. The third step is axially pushing the installation tool and the oriented gripper plate over the protruding, threaded end of the rock bolt, to force the plurality of teeth to frictionally engage therebetween the protruding, threaded end of the rock bolt, while accommodating the threaded end of the rock bolt within a longitudinally oriented cavity within the main body portion of the installation tool. The fourth step is removing the installation tool from operatively, magnetically engaged contact with the magnetically grippable contact surface of the gripper plate against a frictional engagement between the plurality of teeth and the protruding, threaded end of the rock bolt. The fifth optional step is to rotate the installation tool, so as to bring a ramming means mounted on the tool into overlying axial relation to the gripper plate, with a third longitudinally oriented cavity within the ramming means axially aligned to accommodate the protruding, threaded end of the rock bolt therein. Thereafter the ramming means is rammed against the first side of the gripper plate, thereby forcing the teeth of the gripper plate into fully frictionally engaged gripping contact with the threads of the rock bolt, such that the gripper plate is in overlying retaining contact with the mesh screening means.

Other advantages, features and characteristics of the present invention, as well as methods of operation and functions of the related elements of the structure, and the combination of parts and economies of manufacture, will become more apparent upon consideration of the following detailed description and the appended claims with reference to the accompanying drawings, the latter of which is briefly described hereinbelow.

DETAILED DESCRIPTION OF A PREFERRED EMBODIMENT

Figure 1:
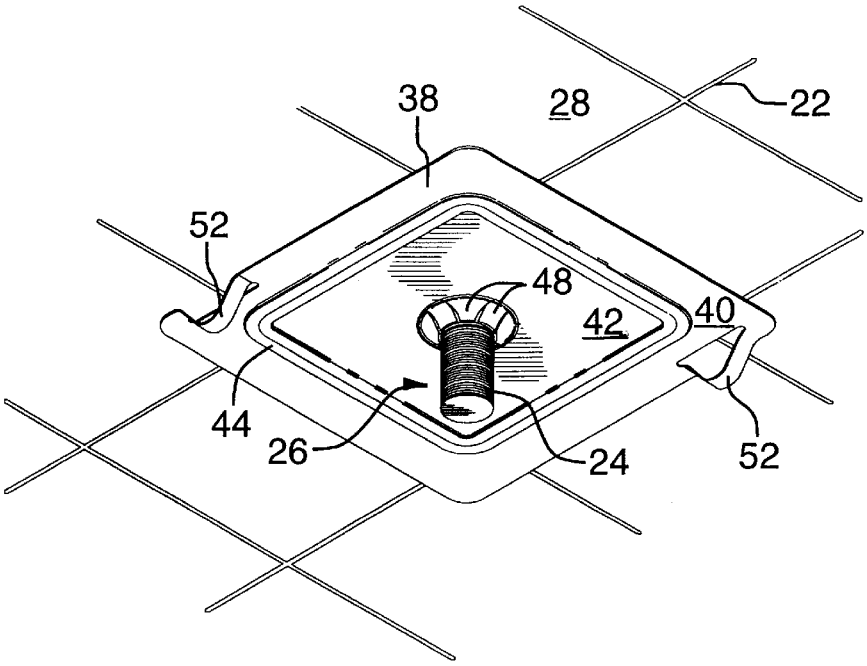
FIG. 1 of the drawings appended hereto is a perspective view from below of a wire mesh screening means secured on the protruding, threaded end portion of a rock bolt inserted into a rock face, utilising a gripper plate in accordance with the system of the present invention.
Figure 6:
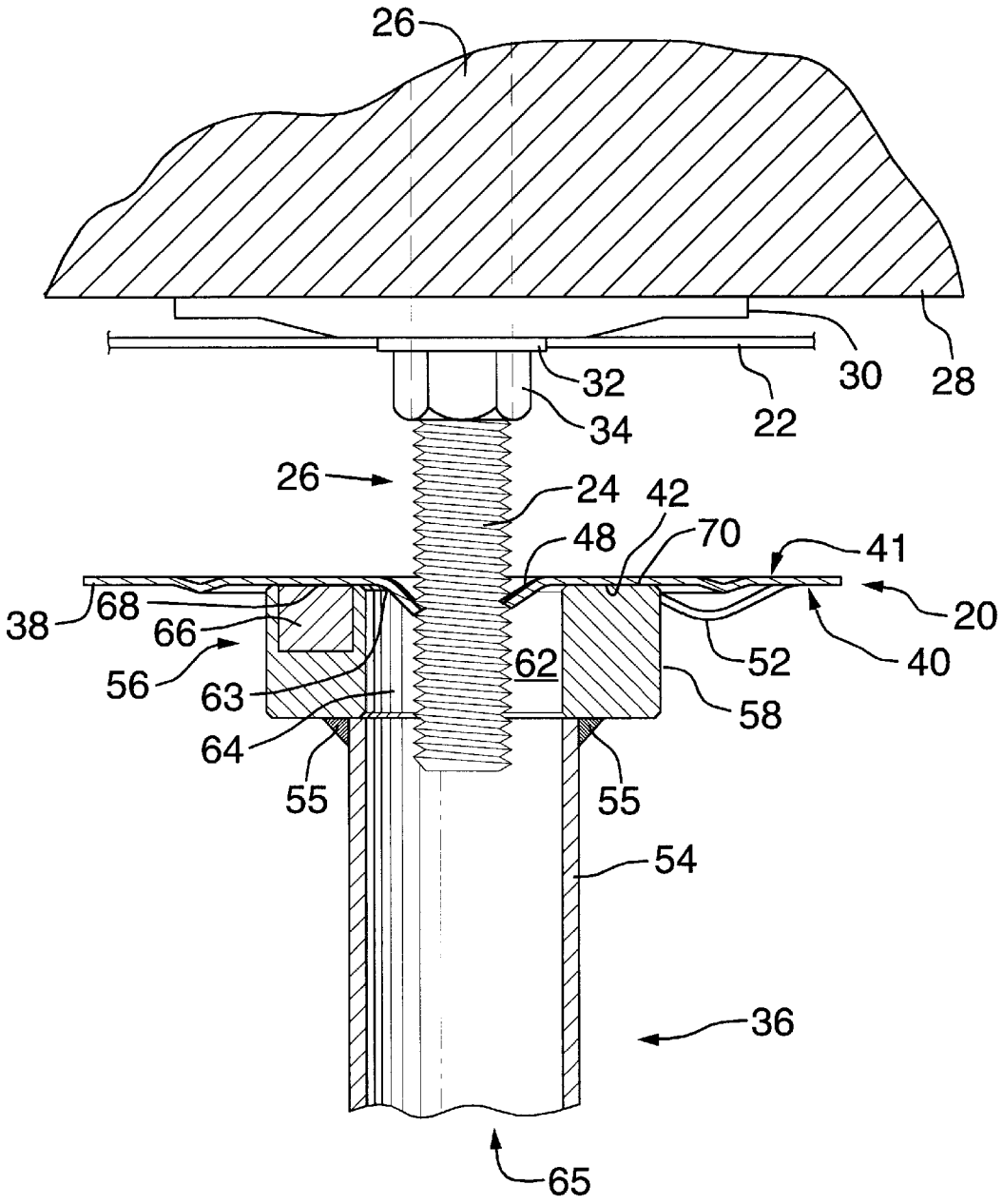
FIG. 6 is a partial view of FIG. 5, enlarged to show greater detail; and, FIG. 7 is a view similar to FIG. 6, with of the gripper plate shown in the fully installed position of FIG. 1.

Referring now to FIGS. 1 and 6 of the drawings, there is shown a push-on gripper plate according to an aspect of the present invention, identified generally by reference numeral 20, for use in the securement of a mesh screening means 22 onto the protruding, threaded end portion 24 of a rock bolt 26 inserted into a rock face 28. The rock bolt 26 is of well-known construction, and is conventionally inserted into a drilled hole (not shown) in the rock face 28, so that the threaded portion 24 protrudes several inches beyond the rock face 28. After such insertion, but prior to installing the gripper plate 20, a conventional retention plate 30 (best seen in FIG. 6) is placed over the threaded portion 24 of the rock bolt 26, followed by a conventional washer 32. A conventional nut 34 is then tightened against the washer 32 and retention plate 30, so as to hold the retention plate 30 against the rock face 28, and thereby anchor the rock bolt 26. Once the rock bolt 26 is installed in this manner, the conventional wire mesh screening means 22 is placed over the protruding, threaded end portion 24 of the rock bolt 26, with the threaded end portion 24 passing through a hole in the screening means 22. The gripper plate 20 is then pushed onto the threaded end portion 24, with the aid of an installation tool in accordance with the present invention (identified in FIG. 6 by the general reference numeral 36), in a manner more fully described below.

Figure 2:
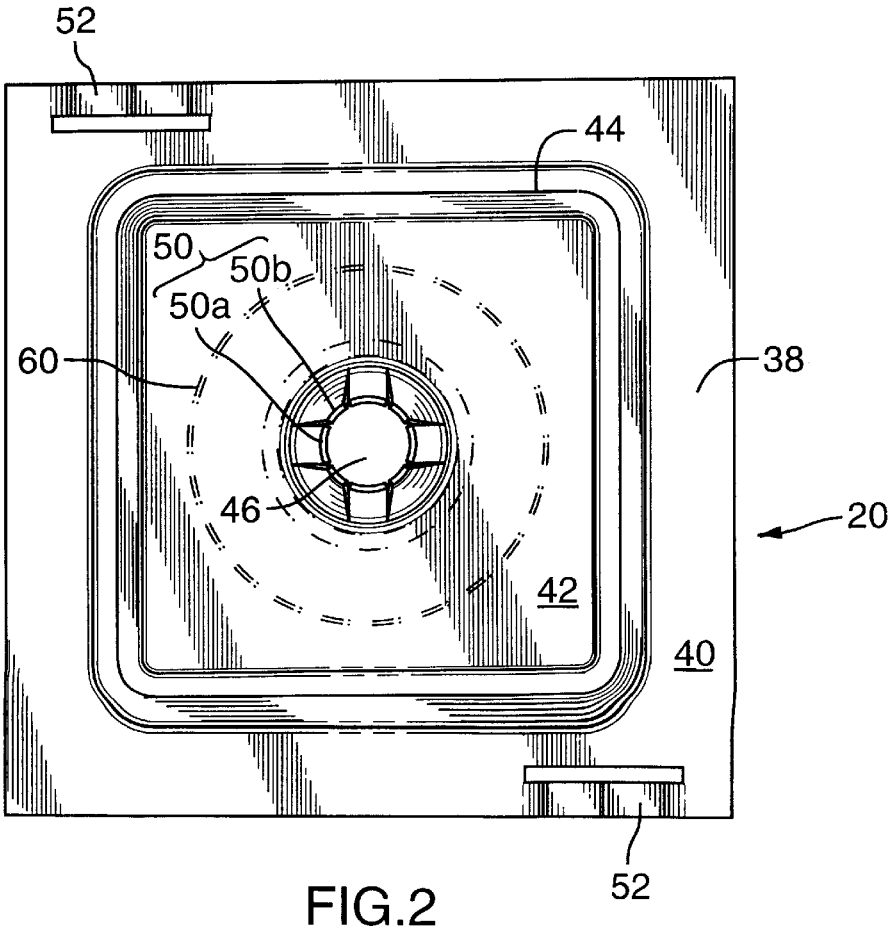
FIG. 2 of the drawings is a plan view of the gripper plate of FIG. 1, showing, in dotted outline, a notional representation of the distal end wall of the main body portion of an installation tool, in an operative installation position, in accordance with the present invention.
Figure 3:
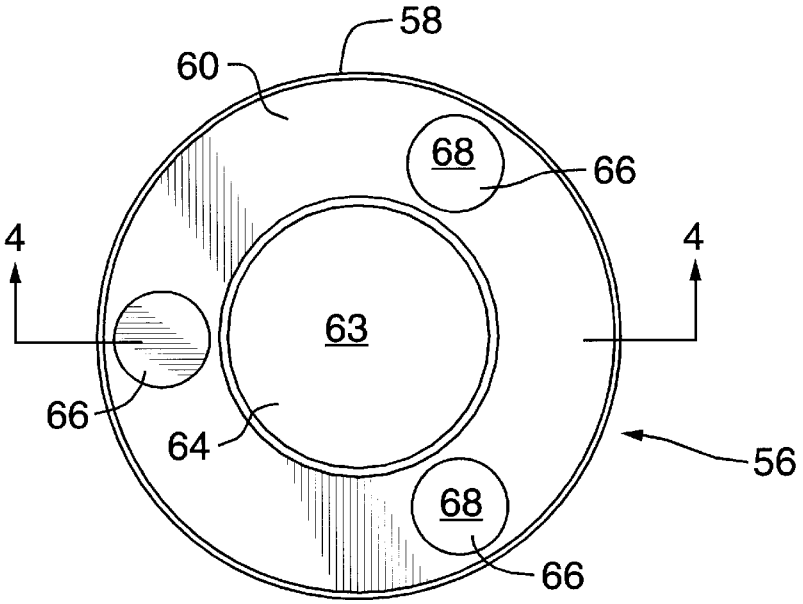
FIG. 3 of the drawings is a plan view of the distal end wall of the main body portion of the installation tool.
Figure 4:
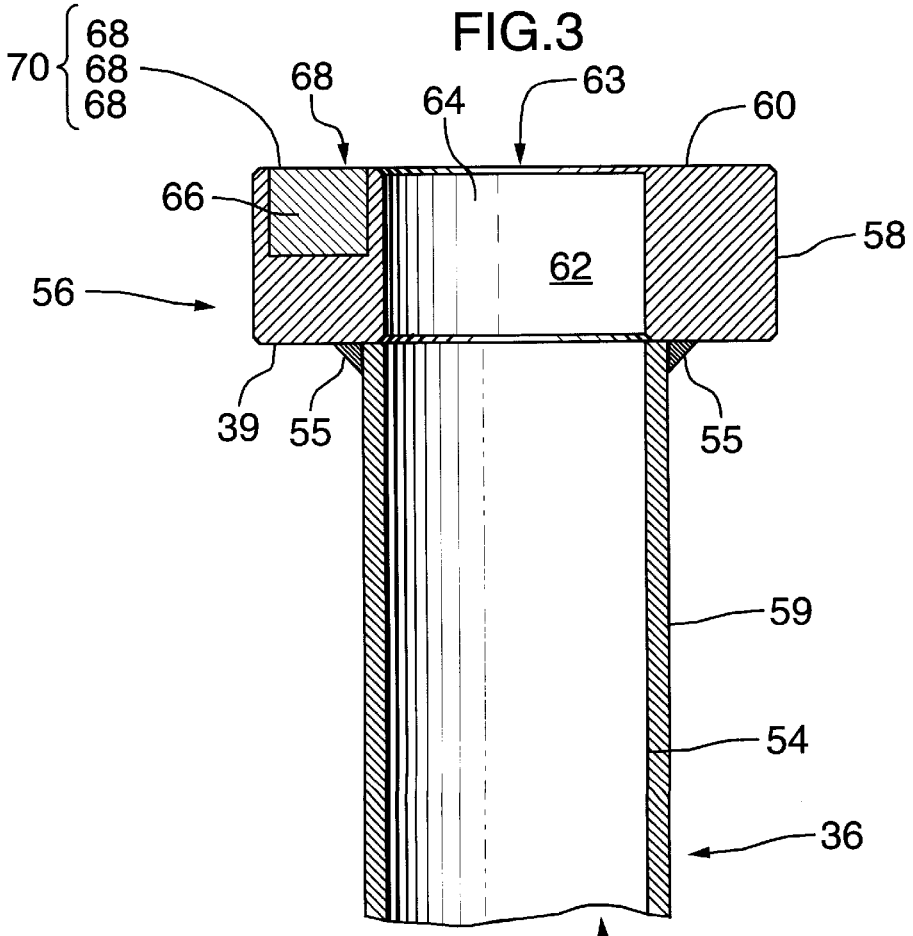
FIG. 4 is a partial vertical sectional view of the installation tool taken along line 4—4 of FIG. 3.
Figure 7:
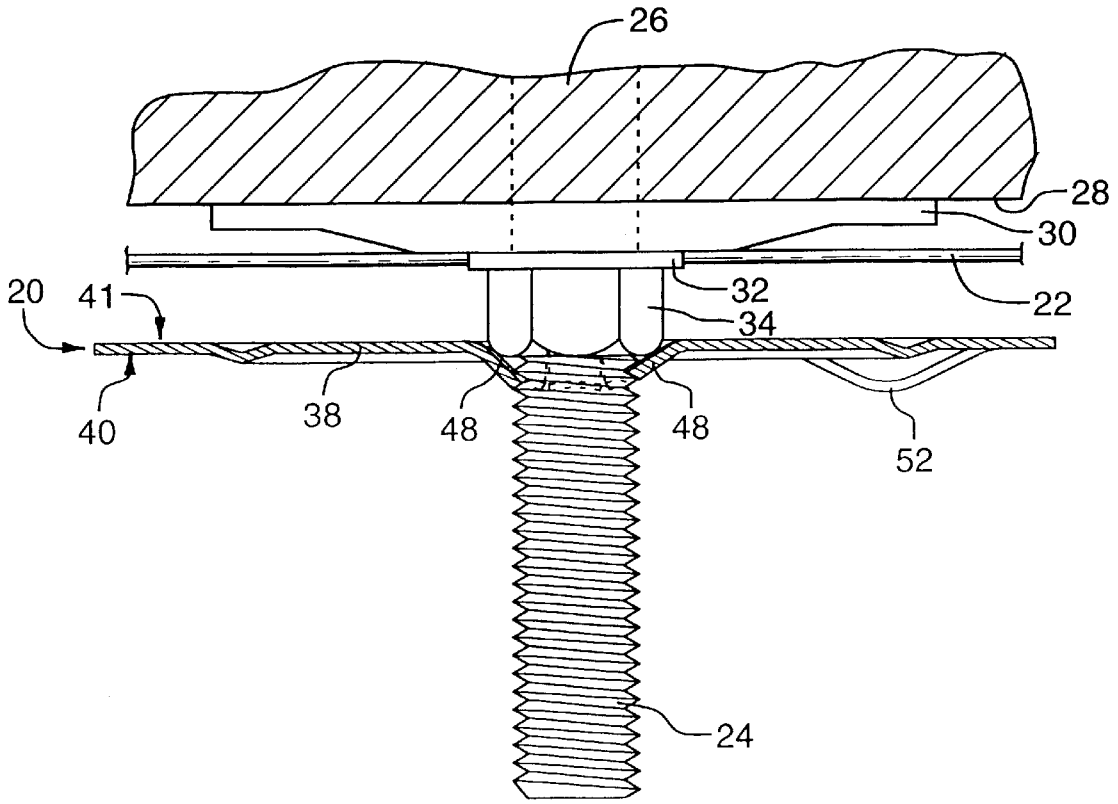

Referring now to FIGS. 2, 6 and 7, the gripper plate 20 comprises a generally planar base portion 38 adapted to overlie the mesh screening means 22. The overall planar shape of the gripper plate 20 may be varied, but according to the preferred embodiment of the present invention the shape is generally square in order to have a maximized surface area of the gripper plate 20 in contact with the mesh screening means 22. The gripper plate 20 has a first side 40 and a second side 41. A magnetically grippable contact surface 42 (see FIGS. 1 and 2) is located on the first side 40 of the planar base portion 38 of the gripper plate 20. The magnetically grippable contact surface 42 is substantially planar, and is preferably surrounded on all sides by a stiffening ridge 44, which stiffening ridge 44 is positioned adjacent to the outer perimeter of the planar base portion 38 of the gripper plate 20. The stiffening ridge 44 is formed integrally with the gripper plate 20 to lend added strength thereto. The gripper plate 20 may be constructed from any material strong enough to withstand significant weight loading, possibly including certain high strength plastic polymer materials or other types of alloys, and having only the magnetically grippable contact surface 42 constructed of a metal capable of being attracted by a magnet. However, in the preferred embodiment of the present invention, the entire gripper plate 20, including the magnetically grippable contact surface 42, is constructed from hardened spring steel.

Referring now to FIG. 2, a central opening 46 in the planar base portion 38 of the gripper plate 20 has a plurality of teeth 48 positioned on the perimeter thereof to fictionally engage the protruding, threaded end portion 24 of the rock bolt 26. Each of the teeth 48 is inclined inwardly toward the centre of the opening 46, and downwardly from the plane defined by the first side 40 of the base portion 38, as best seen in FIGS. 2, 6 and 7. The inclination angle of the teeth 48 is preferably 45 degrees from the plane defined by the base portion 38, but each of such teeth may be several degrees greater or less than 45 degrees. The exact inclination angle of each of the teeth 48 can be routinely calculated, with specific reference to the size of the central opening 46, the diameter of the threaded end portion 24 of the rock bolt 26, and the dimensions and angling of the particular thread pattern used on the end portion 24 of the neck bolt 26. The object of such calculations is to angle the teeth 48 to generally mimic the thread pattern of the nut 34, (which thread pattern is complementary to that of the threaded end portion 24) so as to maximize the axial load bearing characteristics of the gripper plate 20, while at the same time allowing the gripper plate 20 to be axially pushed onto the protruding, threaded end portion 24 of the rock bolt 26 without the absolute need of full threading. The free ends 50 of the teeth 48 are preferably concavely curved (as best seen in FIG. 2), so as to more firmly nest in engaged relation between the individual threads of the protruding, threaded end portion 24 as shown in FIGS. 6 and 7. Together, the teeth 48 circumscribe a circle, and the free ends 50 of each of the teeth 48 alternately define either a 5 degree arc 50*a* or a 3 degree arc 50*b* of the circle. An arrangement of teeth 48 having free ends 50 of alternating sizes is preferred, since it provides optimal contact area between the gripper plate 20 and the threads of the protruding, threaded end portion 24 of the rock bolt 26.

The gripper plate 20 further comprises at least one attachment loop 52 contiguous with and depending downwardly from the first side 40 of the planar base portion 38 of the gripper plate 20 (as seen in FIGS. 2, 6 and 7). The attachment loops 52 will facilitate the throughpassage of flexible attachment lines (not shown), such as rope or wire, therethrough. Supplementary means, such as lamps, cabling, caution flags, etc. may be suspended from the flexible attachment lines.

Reference is now made, in particular, to FIGS. 3–6. The installation tool 36 has an elongated handle portion 54 defining a longitudinal axis identified by line "A" in FIG. 5. A main body portion 56 is rigidly attached adjacent its proximal end wall 39 to the elongated handle portion 54, by a suitable attachment means, such as welding. Throughout the drawings, welds will be identified by the reference numeral 55. The main body portion 56 of the installation tool 36 has an outer sidewall 58, a proximal end wall 39, a distal end wall 60, and an inner sidewall 62. The inner side wall 62 is of substantially closed polygonal cross-section and extends longitudinally from the proximal end wall 39 to terminate at the distal end wall 60. The proximal end wall 39 is oriented substantially transversely to the longitudinal axis identified by line "A" in (see FIG. 5). The distal end wall 60 is oriented in substantially parallel orientation to the proximal end wall 39, and the distal end wall 60 defines a first central portal 63 through which the longitudinal axis passes. The inner sidewall 62 and the distal end wall 60 together define a first longitudinally oriented cavity 64 which is positioned, dimensioned and otherwise adapted, in use, to non-frictionally receive the protruding, threaded end portion 24 of a rock bolt 26 through the first central portal 63 during the installation of a gripper plate 20. The main body portion 56 is preferably of a substantially cylindrical shape, having a substantially cylindrical first cavity 64 therein, and both the main body portion 56 and the first cavity 64 are coaxial about the longitudinal axis presented by line "A". The longitudinal orientation and non-frictional reception of the threaded end 24 of a rock bolt 26 through the first central portal 63 and within the cavity 64 can be best seen in FIG. 6.

The main body portion 56 of the installation tool 36 has a means for exerting an attractive magnetic force in a direction substantially parallel to the longitudinal axis (identified by line "A" in FIG. 5) so as to magnetically attract the magnetically grippable contact surface 42 of the gripper plate 20 into magnetically retained contacting engagement with the distal end wall 60 of the installation tool 36. In the preferred embodiment described herein, the means for exerting an attractive magnetic force is a plurality of permanent magnets 66, mounted on the distal end wall 60 of the main body portion 56 in surrounding relation to the central portal 63. The plurality of permanent magnets 66, 66, 66 are spaced from one another in equidistant radial orientation about the longitudinal axis. It is preferable for each of the plurality of permanent magnets 66 to be embedded within the distal end wall 60 so as to present an exposed magnet surface 68 of each permanent magnet 66 being substantially flush with the distal end wall 62 of the cylindrical main body portion 56. The plurality of exposed magnet surfaces 68,68,68 together form a substantially planar magnetic engagement surface 70 oriented substantially transverse to the longitudinal axis of the handle portion 54 of the installation tool 36. The magnetically grippable contact surface 42 of the gripper plate 20 is also substantially planar, and the magnetically grippable contact surface 42 has a surface area at least as large as the surface area of the planar magnetic engagement surface 70 of the installation tool 36. In fact the magnetically grippable contact surface 42 of the gripper plate preferably has a larger surface area than that of the planar magnetic engagement surface 70 in order to eliminate the need for precise positioning of the planar magnetic engagement surface 70 adjacent the magnetically grippable contact surface 42 of the gripper plate in order to operatively, magnetically engage the gripper plate 20. Moreover, given that the operative engagement of the installation tool 36 and the gripper plate 20 is by means of an attractive magnetic force holding the planar magnetic engagement surface 70 and the magnetically grippable contact surface 42 in magnetically retained contacting relation, there is no need for any lateral guides or tabs to align the installation tool, or to secure the installation tool to the gripper plate, as was required in the prior art. In fact, as shown in dotted outline in FIG. 2, when the distal end wall 60 of the installation tool 36 is in an operative installation position overlying magnetically grippable contact surface 42 of the gripper plate, and is axially aligned so as to receive the threaded end portion 24 of a rock bolt 26 through the first central portal 63 and within the first longitudinally oriented cavity 64 and having the plurality of teeth 48 aligned within the first cavity 64, the outer wall 58 of the main body portion 56 of the installation tool preferably does not contact the stiffening ridge 44 of the gripper plate 20. FIG. 2 shows a perfectly centred alignment of the installation tool 36 and gripper plate 20; however, in practice, so long as the distal end wall 60 of the installation tool 36 is aligned sufficiently for passage of the protruding, threaded end portion 24 of the rock bolt 26 through the first central portal 63 into accommodation within the cavity 64, then operative magnetic engagement of the gripper plate 20 and installation tool 36 will be successful. The orientation and spacing of the permanent magnets 66,66,66, together, provides that the planar magnetic engagement surface 70 exerts an attractive magnetic force which is adjacent to and equidistantly spaced around the first central portal 63 of the main body portion 56 of the installation tool 36. The balanced attractive magnetic force emanating from the planar magnetic engagement surface 70 permits the main body portion 56 of the installation tool 36 to magnetically engage the magnetically grippable contact surface 42 of the gripper plate 20 in a vertically balanced planar surface-to-surface alignment without any tilting of the gripper plate 20 relative to the installation tool 36. Such alignment will ensure, that during installation, when the gripper plate 20 is forced onto the threaded end 24 of the rock bolt 26 to engage the threads of the rock bolt 26, there will not be unwanted deformation of the teeth 48 or binding thereof in the threads of the rock bolt 26 due to tilting or misalignment of the gripper plate 20. Instead, the gripper plate 20 will consistently be substantially perpendicular to the rock bolt 26 throughout the installation of the gripper plate 20 onto the protruding, threaded end portion 24 of the rock bolt 26.

Figure 5:
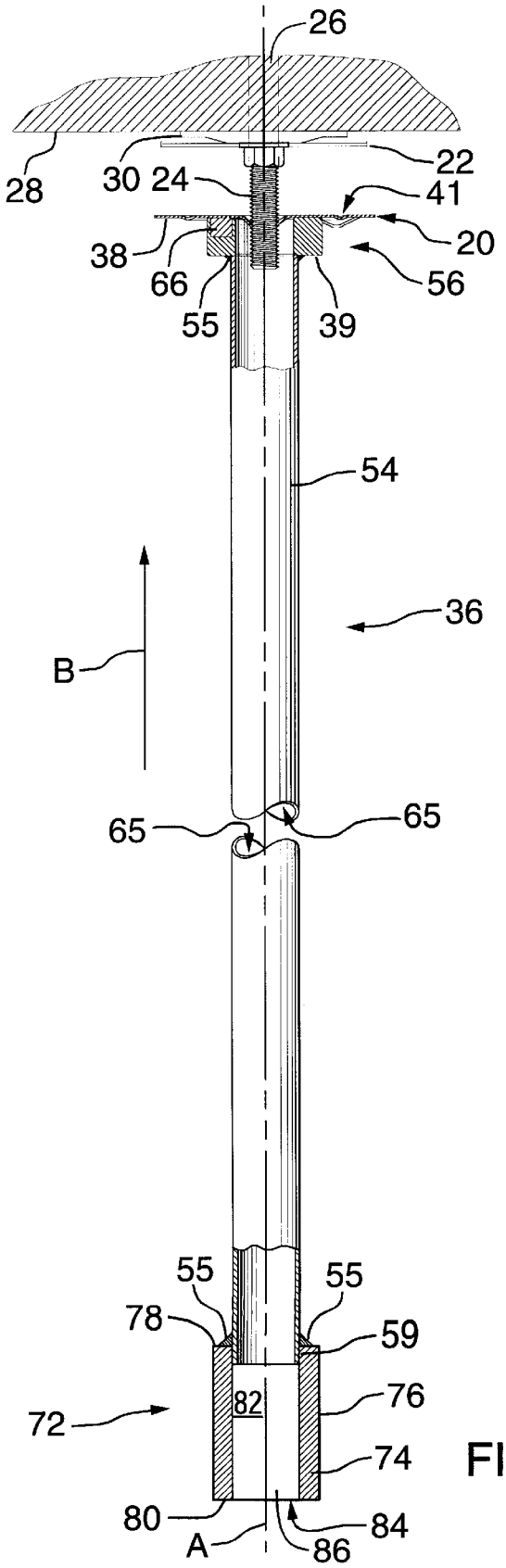
FIG. 5 is a schematic view of a gripper plate partially installed in overlying relation to a wire mesh screening means secured to the end of a rock bolt, utilizing an installation tool according to the present invention, said installation tool being shown partially in section.

Since the installation of the gripper plate 20 onto the protruding threaded end portion 24 of a rock bolt 26 requires the exertion of significant force, the cylindrical main body portion 56 of the installation tool 36 is thicker in cross section than the elongated handle portion 54 to enable the main body portion 56 to withstand the pressures associated with forcing the gripper plate 20 to engage the threads on the protruding, threaded end portion 24 of the rock bolt 26. More particularly, as best seen in FIG. 5, although the cylindrical first cavity 64 in the main body portion 56 and a second longitudinally oriented cavity 65 in the handle portion 54 are contiguous and have substantially the same internal diameters, the outer diameter of the main body portion 56, as defined by the outer sidewall 58, is preferably at least 1.5 times the internal diameter of the first 64 and second 65 cavities. By contrast, the handle portion 54 is preferably constructed from readily available steel piping, having a nominal outside diameter of 1¾", and the handle portion 54, so constructed. The additional thickness of the main body portion 56 provides sufficient area on the distal end wall 60 to accommodate the plurality of permanent magnets 66 embedded therein adjacent the central portal 63 in the main body portion 56. As best illustrated in FIG. 6, the first longitudinally oriented cavity 64 within the main body portion 56 and the second longitudinally oriented cavity 65 within the elongated handle portion 54 are dimensioned and otherwise adapted, in use, to jointly, non-frictionally receive the protruding, threaded end portion 24 of the rock bolt 26 following the entry thereof through the first central portal 63 during installation of the gripper plate.

Referring now to FIG. 5, the installation tool further comprises a ramming means 72 rigidly attached to the opposite other end of the handle portion 54 by conventional means such as welding 55. The ramming means 72 is comprised of a ram portion 74 having an outer sidewall 76, a proximal end wall 78 oriented substantially transversely to the longitudinal axis identified by line "A", a distal end wall 80, and an inner sidewall 82. The inner wall 82 is of substantially closed polygonal cross-section and extends longitudinally from the proximal end wall 78 to terminate at the distal end wall 80 spaced from the proximal end wall 78. The distal end wall 80 is oriented in substantially parallel orientation to the proximal end wall 78, and the distal end wall 80 defines a second central portal 84 through which the longitudinal axis passes. The inner sidewall 82 and the distal end wall 80 together define a third longitudinally oriented cavity 86 which is dimensioned and otherwise adapted, in use, to non-frictionally receive the protruding, threaded end portion 24 of a rock bolt 26 through the second central portal 84 during the installation of a gripper plate 20. Both the ram portion 74 and the third longitudinally oriented cavity 86 are preferably of a substantially cylindrical shape and are coaxial about the longitudinal axis identified by line "A". Moreover, all of the first 64, second 65 and third 86 longitudinally oriented cavities are preferably contiguous. The ram portion 74 of the ramming means 72 may be constructed from a segment of thick-walled steel piping or may be cast specially. The second longitudinally oriented cavity 86 preferably has an internal diameter which is dimensioned for close fitting engagement within the outer wall 59 of the elongated handle portion 54 of the installation tool 36. In order to provide sufficient strength and robustness, the outer diameter of the of the main body portion 74 of the ramming means 72 is at least 1.5 times the diameter of the second longitudinally oriented cavity 86. The function of the ramming means 72 is to provide a robust structural member which can be rammed against the gripper plate 20, while non-frictionally receiving the threaded end portion 24 of the rock bolt 26 within the third cavity 86, once the gripper plate has been initially engaged with the threaded end 24 of the rock bolt 26, to drive home the teeth 48 of the gripper plate 20 into fully frictionally engaged gripping contact with the threads of the rock bolt 26, such that the second side 41 of the gripper plate 20 is pushed into physical contact with the nut 34 which anchors the rock bolt 26 to the rock face 28. At this position, the gripper plate 20 is also in functionally overlying retaining contact the wire mesh 22.

In use, the system of the present invention is employed according to the following method in order to install a gripper plate 20 on the protruding, threaded end portion 24 of a rock bolt 26 inserted into a rock face 28. First, an operator orients a gripper plate 20, selected from a stockpile of similar gripper plates, on the planar magnetic engagement surface 70 of the installation tool, with the magnetically grippable contact surface 42 of the gripper plate 20 engaged by the planar magnetic engagement surface 42 of the installation tool 36 and the plurality of teeth 48 operatively oriented within the first longitudinally oriented cavity 64 of the main body portion 56 of the installation tool 36. The operator need not bend over to manually retrieve a gripper plate 20 and place it onto the installation tool in proper alignment. By operation of the attractive magnetic force, the main body portion 56 of the installation tool 36 will operatively, magnetically engage the gripper plate 20. As discussed above, the magnetically grippable contact surface 42 of the gripper plate 20 will, due to the alignment and positioning of the permanent magnets 66 in the main body portion 56, automatically be substantially properly aligned both laterally and vertically, with the planar magnetic engagement surface 70 of the installation tool 36, in magnetically retained contact. The installation tool 36, with the gripper plate 20 so oriented, is then positioned adjacent the protruding, threaded end portion 24 of the rock bolt 26 with the central opening 46 of the gripper plate 20 axially aligned with the protruding, threaded end portion 24 of the rock bolt 26. The installation tool 36 with the oriented gripper plate 20 is then axially pushed (in the direction of arrow "B" in FIG. 5) over the protruding, threaded end portion 24 of the rock bolt 26 to force the plurality of teeth 48 to frictionally engage therebetween the protruding, threaded end 24 of the rock bolt 26. At the same time, the threaded end 24 of the rock bolt 26 passes through the central portal 63 in the main body portion 56, and is accommodated within the first longitudinally oriented cavity 64 within the main body portion 56 of the installation tool 36, as shown in FIGS. 5 and 6. Once there has been frictional engagement of the threaded end 24, the installation tool 36 is removed from operatively, magnetically engaged contact with the magnetically grippable contact surface 42 of the gripper plate 20. Such removal is typically accomplished by the operator pulling gently upon the handle portion 54 of the installation tool 36 against the frictional engagement between the plurality of teeth 48 and the protruding, threaded end portion 24 of the rock bolt 26. The installation tool 36 is then rotated about a horizontal axis, so as to bring the distal end wall 80 of the ramming means 72 into overlying axial relation to the first side 40 of the gripper plate 20, with the third longitudinally oriented cavity 86 in the ram portion 74 axially aligned to accommodate the protruding, threaded end portion 24 of the rock bolt 26. The ramming means 72 is then rammed against the first side 40 of the gripper plate 20 with significant manual force in order to force the teeth 48 of the gripper plate 20 into fully frictionally engaged gripping contact with the threads of the rock bolt 26. During the ramming of the ramming means 72, the protruding, threaded end 24 of the rock bolt 26 passes through the second central portal 84 in the ram portion 74 of the ramming means 72, and is non-frictionally received within the third longitudinally oriented cavity 86 of the ramming means 72. The fully frictionally engaged gripping contact is obtained when the second side 41 of the gripper plate comes to rest against the nut 34 which is part of the apparatus for anchoring the rock bolt 26 to the rock face 28 and in overlying retaining contact with the mesh screening means 22, as shown in FIG. 7 and discussed above. Typically, the operator will be able to exert sufficient manual force during the ramming step in order to achieve fully frictionally engaged gripping contact, since the installation tool of the installation tool 36 according to the present invention is a complete installation device and need not be fitted onto the end of a pneumatic drill. Accordingly, the installation tool 36 is much lighter to lift and easier to manoeuver so as to generate a significant ramming force to be applied to the gripper plate 20, even when the operator is installing the gripper plate 20 to a rock face 28 which is above the operator's head.

Preliminary pull tests were done on steel gripper plates as illustrated constructed of C1055 spring steel, hardened and tempered to a Rockwell "C" scale hardness of RC 43 to 47, with an average hardness of RC 46. The thickness of the plate metal was 0.060 inches, and the outside perimeter was 5¾ inches square. The threaded section of a ⅝" outer diameter rock bolt was inserted into a tensioner and the gripper plate was installed on the rock bolt as previously described. Loads were then applied to the gripper plates in three different modes as follows: a) directly to the hub of the plates; b) as an annulus 2" from the hub of the plates; and, c) as an annulus 4" from the hub of the plate. In the hub loading mode a), average loading at failure was 3.75 tons. In the 2" annulus loading mode b), average loading at failure was 3.5 tons, and in the 4" annulus loading, the average loading at failure was 3.75 tons. Similar test conducted on the gripper plates using a ¾" outer diameter rock bolt resulted in average failure loads of 3.75 tons. Failure during testing was gradual, on a thread by thread basis, with the gripper plates tending to slide down the rock bolt a thread at a time. Unlike the prior art gripper plates, including the plate disclosed in U.S. Pat. No. 4,740,111, the threads of the rock bolts were not damaged after failure. Moreover, the gripper plates tested could, after failure, still be re-installed on the rock bolt by hand, and after such re-installation still carried an average residual load of almost 1 ton for the ⅝ inch bolts and 1 ton for the ¾ inch bolts. These factors combine to provide a better chance than with known gripper plates to contain the mesh screening means following an instantaneous loading situation. Moreover, these tests indicate consistent failure loads in excess of the failure loads of most mesh screening means used in mining operations, thus confirming that the subject gripper plates are not the weak link in the supplementary support system described herein.

Although this invention has been disclosed with reference to a particular preferred embodiment as shown and described, it is to be understood that it is not to be limited to such embodiment and that other alternatives, such as the use of other types of magnets, such as electromagnets in the installation tool could be employed, and are envisaged within the scope of the following claims.

I claim:

1. A system for securement of a mesh screening means on to the protruding, threaded end portion of a rock bolt inserted into a rock face, comprising, in combination:

(a) a push-on gripper plate having a generally planar base portion adapted to overlie the mesh screening means, said planar base portion having, on a first side thereof, a plurality of teeth adapted to frictionally engage said protruding, threaded end portion, and a magnetically grippable contact surface; and (b) an installation tool comprising:

(I) an elongated handle portion defining a longitudinal axis; and (II) a main body portion comprising:

(i) a proximal end wall oriented substantially transversely to said longitudinal axis;

(ii) an inner sidewall of substantially closed polygonal cross-section extending longitudinally from said proximal end wall to terminate in a distal end wall spaced from said proximal end wall, said distal end wall being oriented in substantially parallel orientation to said proximal end wall and defining a first central portal through which said longitudinal axis passes; said inner sidewall and said distal end wall together defining, within the main body portion, a first longitudinally oriented cavity dimensioned and otherwise adapted, in use, to non-frictionally receive said protruding, threaded end portion of the rock bolt following entry of said protruding, threaded end portion through said first central portal during installation of said push-on gripper plate; and (iii) a means for exerting an attractive magnetic force in a direction substantially parallel to said longitudinal axis, said means being positioned on the distal end wall of the of the main body portion so as to magnetically attract the magnetically grippable contact surface of said gripper plate into magnetically retained contacting engagement with the distal end wall of said installation tool;

said elongated handle portion being rigidly attached to said main body portion adjacent said proximal end wall, thereby to effect said substantially transverse orientation of said proximal end wall to said longitudinal axis.

2. The system according to claim 1, wherein said main body portion and said first longitudinally oriented cavity are substantially cylindrical and coaxial about said longitudinal axis.

3. The system according to claim 2, wherein said means for exerting said attractive magnetic force comprises a plurality of permanent magnets mounted on the distal end wall of the main body portion in surrounding relation to said first central portal, said plurality of permanent magnets being spaced from one another in equidistant radial orientation about said longitudinal axis.

4. The system according to claim 3, wherein each of the plurality of magnets is embedded within the distal end wall so as to each present an exposed magnet surface substantially flush with the distal end wall, the plurality of exposed magnet surfaces together forming a substantially planar magnetic engagement surface oriented substantially transverse to the longitudinal axis of the handle portion of said installation tool.

5. The system according to claim 4, wherein the magnetically grippable contact surface of said gripper plate has a surface area at least as large as the planar magnetic engagement surface of said installation tool.

6. The system according to claim 3, wherein the main body portion defines an outer diameter which is at least 1.5 times the internal diameter of said first longitudinally oriented cavity so as to accommodate mounting of said plurality of permanent magnets.

7. The system according to claim 6, wherein the elongated handle portion of the installation tool is substantially cylindrical and coaxial about said longitudinal axis.

8. The system according to claim 7, wherein the elongated handle portion defines a second longitudinally oriented cavity contiguous with and having substantially the same internal diameter as the first longitudinally oriented cavity of the main body portion.

9. The system according to claim 8, wherein the first longitudinally oriented cavity of the main body portion and the second longitudinally oriented cavity of the handle portion are jointly dimensioned and otherwise adapted, in use, to non-frictionally receive said protruding, threaded end portion of the rock bolt following entry of said protruding, threaded end portion through said first central portal during installation of said push-on gripper plate.

10. The system according to claim 8, wherein the installation tool further comprises a ramming means rigidly affixed to the elongated handle portion at its opposite other end.

11. The system according to claim 10, wherein the ramming means comprises:

(a) a ram portion having a proximal end wall oriented substantially transversely to said longitudinal axis;

(b) an inner sidewall of substantially closed polygonal cross-section extending longitudinally from said proximal end wall to terminate in a distal end wall spaced from said proximal end wall, said distal end wall being oriented in substantially parallel orientation to said proximal end wall and defining a second central portal through which said longitudinal axis passes;

(c) said inner sidewall and said distal end wall together defining, within said ram portion, a third longitudinally oriented cavity dimensioned and otherwise adapted, in use, to non-frictionally receive said protruding, threaded end of the rock bolt following entry of said protruding, threaded end portion through said second central portal during installation of said push-on gripper plate.

12. The system according to claim 11 wherein said ram portion and said third longitudinally oriented cavity are substantially cylindrical and coaxial about said longitudinal axis.

13. The system according to claim 12 wherein said first longitudinally oriented cavity of said main body portion, said second longitudinally oriented cavity of said handle portion, and said third longitudinally oriented cavity of said ram portion are substantially contiguous.

14. The system according to claim 13 wherein the ram portion defines an outer diameter at least 1.5 times greater than the internal diameter of the third longitudinally oriented cavity of the ram portion.

15. The system according to claim 12 wherein the third longitudinally oriented cavity of the ram portion has an internal diameter dimensioned for close fitting engagement with an outer wall of the elongated handle portion.

16. The system according to claim 1, wherein the gripper plate further comprises an attachment loop contiguous with and depending from the first side of the gripper plate.

17. The system according to claim 1, wherein the gripper plate further comprises a central opening in said planar base portion having said plurality of teeth positioned on the perimeter of said central opening, the teeth being directed inwardly toward the centre of said central opening and downwardly from the plane defined by the first side of the base portion, said teeth being dimensioned and otherwise adapted to frictionally engage therebetween the threaded end of the rock bolt to hold the gripper plate on the end of the rock bolt over the mesh screening means.

18. The system according to claim 17, wherein the planar base portion of the gripper plate further comprises a raised stiffening ridge adjacent an outer perimeter of said planar base portion.

19. The system according to claim 18 wherein the magnetically grippable contact surface of the gripper plate is positioned between said plurality of teeth and said raised stiffening ridge.

20. The system according to claim 19, wherein each of said plurality of teeth has a free end, each said free end being concavely curved.

21. The system according to claim 20, wherein the free end of each alternate one of said teeth defines approximately 3° of a circle, and the free end of each alternate other one of said teeth defines approximately 5° of a circle.

22. The system according to claim 21, wherein the inclination angle of each of the teeth is approximately 45° to the horizontal.

23. The system according to claim 1, wherein the gripper plate is constructed of hardened, spring steel.

24. The system according to claim 1, wherein the gripper plate is of generally square plan outline.

25. A method for installing, on the protruding, threaded end portion of a rock bolt inserted into a rock face, in overlying retaining contact with a mesh screening means, a gripper plate having a plurality of teeth positioned on the perimeter of a central opening in the gripper plate, comprising the steps of:

(a) orienting said gripper plate, selected from a stockpile of such gripper plates, on a planar magnetic engagement surface of an installation tool, with a magnetically grippable contact surface of said gripper plate engaged by said planar magnetic engagement surface of the installation tool and said teeth operatively oriented within a first longitudinally oriented cavity of said installation tool, thereby to releasably, magnetically engage the gripper plate to a main body portion of the installation tool, said installation tool having a second longitudinally oriented cavity thereof;

(b) positioning the oriented gripper plate adjacent the protruding, threaded end of the rock bolt, with the central opening of said gripper plate axially aligned with said protruding, threaded end of the rock bolt;

(c) axially pushing the installation tool and the oriented gripper plate over the protruding, threaded end of the rock bolt to force the plurality of teeth to frictionally engage therebetween the protruding, threaded end of the rock bolt, while accommodating the threaded end of the rock bolt within said first longitudinally oriented cavity; and, (d) removing the installation tool from said operatively, magnetically engaged contact with the magnetically grippable contact surface of the gripper plate against a frictional engagement between said plurality of teeth and said protruding, threaded end of the rock bolt.

26. The method of claim 25, further comprising the additional steps of:

(e) rotating the installation tool so as to bring a ramming means mounted on said tool, into overlying axial relation to the gripper plate, with a third longitudinally oriented cavity within the ramming means axially aligned to accommodate the protruding, threaded end of the rock bolt therein; and, (f) ramming the ramming means against a first side of the gripper plate, thereby to force the teeth of the gripper plate into fully frictionally engaged gripping contact with the threads of the rock bolt, such that the gripper plate is in overlying retaining contact with the mesh screening means.

* * * * *